US006958015B2

(12) United States Patent
Luciano, Jr. et al.

(10) Patent No.: US 6,958,015 B2
(45) Date of Patent: Oct. 25, 2005

(54) MOVABLE GAMING MACHINE TRAY

(75) Inventors: Robert A. Luciano, Jr., Reno, NV (US); Robert Anderson, Reno, NV (US)

(73) Assignee: Sierra Design Group, Las Vegas, NV (US)

( * ) Notice: Subject to any disclaimer, the term of this patent is extended or adjusted under 35 U.S.C. 154(b) by 0 days.

(21) Appl. No.: 10/927,302

(22) Filed: Aug. 25, 2004

(65) Prior Publication Data

US 2005/0020364 A1 Jan. 27, 2005

Related U.S. Application Data

(63) Continuation of application No. 10/199,144, filed on Jul. 19, 2002, now Pat. No. 6,866,265.

(51) Int. Cl.[7] ..... A63F 11/00
(52) U.S. Cl. ..... 463/46; 273/148 R
(58) Field of Search ..... 463/46, 47; 273/148 R, 273/274; 248/309.1, 311

(56) References Cited

U.S. PATENT DOCUMENTS

| | | | | |
|---|---|---|---|---|
| 3,559,869 | A | | 2/1971 | Reynolds |
| 4,087,126 | A | | 5/1978 | Wynn |
| D249,712 | S | | 9/1978 | Dolezal |
| 4,270,724 | A | | 6/1981 | McMullen |
| 4,286,742 | A | | 9/1981 | Pellegrino |
| 4,643,421 | A | | 2/1987 | Meyer et al. |
| 4,846,333 | A | | 7/1989 | Kissick |
| 4,858,796 | A | | 8/1989 | Roth |
| 4,896,611 | A | | 1/1990 | Lorenzini |
| 4,942,328 | A | | 7/1990 | Price |
| 4,953,772 | A | | 9/1990 | Phifer |
| 5,205,452 | A | | 4/1993 | Mankey |
| 5,221,032 | A | | 6/1993 | Bott et al. |
| 5,335,787 | A | | 8/1994 | Finchum et al. |
| 5,487,519 | A | | 1/1996 | Grabowski |
| 5,533,772 | A | | 7/1996 | Volkers et al. |
| 5,667,180 | A | | 9/1997 | Duckworth |
| 5,688,174 | A | | 11/1997 | Kennedy |
| 5,887,940 | A | | 3/1999 | Anderson et al. |
| 5,906,348 | A | * | 5/1999 | Orenstein ..... 248/311.2 |
| 6,116,597 | A | | 9/2000 | Rowe et al. |
| 6,290,229 | B1 | | 9/2001 | Perez |
| 6,779,794 | B2 | * | 8/2004 | Hedrick et al. ..... 273/148 R |
| 2003/0062673 | A1 | | 4/2003 | Hedrick et al. |

* cited by examiner

*Primary Examiner*—Vishi K. Mendiratta
(74) *Attorney, Agent, or Firm*—Brown Rayman Millstein Felder & Steiner LLP

(57) ABSTRACT

This specification discloses trays for use with a gaming machine. At least a first tray is mountable in adjacent intermediate the gaming interface side of a gaming machine and a game player so that the user may readily rest or access a drink and food located on the tray. A second tray may also be mountable on the first tray in order to expand or alter the tray support configuration provided the two trays together. The tray(s) may be removably mounted to the front of the gaming machine, or they may be rotatably or moveably mounted on the side of the gaming machine. The trays are preferably made of economical, molded, lightweight, resilient, and machine-washable materials, such as polystyrene or other plastic. The trays may also be made of other materials, which when used in conjunction with covers, can help maintain the temperature of food at other than room temperature.

19 Claims, 17 Drawing Sheets

MOVABLE GAMING MACHINE TRAY

CROSS REFERENCE TO RELATED DOCUMENTS

This application is a continuation of U.S. Utility Application No. 10/199,144, filed Jul. 19, 2002 now U.S. Pat. No. 6,866,265, which is hereby incorporated by reference.

FIELD OF THE INVENTION

The present invention relates to providing trays on gaming machines, such as those that provide games of chance or arcade games. More particularly, the present invention relates to 5 providing gaming machine trays that are more conveniently locatable with respect to the user.

BACKGROUND

Gaming machines have been in prominent and growing use for over a century. The terms "gaming machines" mean machines that provide a user with the opportunity to play a game of chance (such as for example slot machines), video gambling machines, and arcade video games. Establishments that utilize gaming machines have become ubiquitous. With such a gaming machine, the user plays the game by sitting or standing in front of the machine and inserting coins or other forms of credit, and/or manipulating one or more control on the game provided by the gaming machine.

Notwithstanding the widespread presence of these types of gaming machines for many scores of years and the very substantial industry that has developed to provide such gaming machines for gaming establishments and businesses, the applicant has discovered that the prior art gaming machines typically present a problem for the users of these machines and those who maintain them. The problem is that these machines do little if anything to provide adequate, much less convenient, temporary resting places for drinks, food, or other items that users very often will have with them, or prefer to have with them, when playing games on the machines. This situation has presented a particularly significant problem for gaming users who have disabilities of the type making it difficult to move from the front of a gaming machine in order to access drinks, food, and other items while using the gaming machine.

One example of a prior art gaming machine and associated resting device is disclosed in U.S. Pat. No. 4,846,333 to Kissick, entitled "Coin Caddy Attachment for Vending Machine." The Kissick reference discloses a coin caddy that a user can carry from one gaming machine to another gaming machine and rest in position on the coin slot device on one or more such machines. The Kissick coin caddy has limited utility since it is designed to carry only coins. Interestingly, the Kissick reference notes that gaming machine users will desire not only to operate the machine but also do so while consuming food or beverages, etc. See Col. 1, 11. 62–68.

Yet another prior art gaming machine and resting device is disclosed in U.S. Pat. No. 6,290,229 to Perez, entitled "Customer Support Device for a Gaming Machine." The Perez device provides a small rest for drinks and other items, and the Perez rest is fixedly attached to the side of the gaming machine. The Perez rest is therefore somewhat limited in utility due to its size, and it is not readily adaptable to store larger items, such as larger food items. The Perez rest is also somewhat inconveniently located since it is located off to the side of the machine. Also, the Perez rest can be difficult to clean since it is rigidly attached to the machine, and it cannot be removed and, for example, washed in a dish washing machine.

Thus, while food trays themselves have long been utilized in other fields of art, the applicant believes that the gaming machine industry has not fully appreciated the need for them and their utility and advantages if developed and made more widely available, convenient, or useful in connection with gaming machines and users of them. See, e.g., U.S. Pat. No. 4,858,796 to Roth, entitled "Vehicle Tray"; and U.S. Pat. No. 6,102,476 to May et al., entitled "Computer Furniture With Integrated Computer."

BRIEF SUMMARY OF THE ASPECTS OF THE INVENTION

The applicant has invented a gaming machine tray for use in connection with gaming machines. The gaming machine tray preferably provides a rest for food and other items and is removably mountable adjacent the front side of the gaming machine. As a result, in the most commonly disclosed use to provide a readily removable rest tray in conjunction with an associated gaming machine, the gaming machine tray is located intermediate the front, operational side of the 10 gaming machine and the gaming machine user at the gaming machine.

In one embodiment, the gaming machine tray is removably mountable on the front, operational side of the gaming machine. This embodiment may include one or more additional trays that can be mounted to, or in association with, a base tray in order to alter or expand the overall tray configuration on a gaming machine, thereby providing differing resting areas for drinks, food, or other items that the gaming machine user may desire to have within convenient reach while playing, or otherwise be located adjacent, the associated gaming machine.

The gaming machine tray may also consist of a mounting section and a separable food support section, which is preferably interchangeable with differing types of mounting sections for use on differing types of gaming machines.

In another embodiment, the gaming machine tray is rotatably or movably mounted to a side of the gaming machine so that it is moveable from the side of the machine to a position in front or adjacent the front of the gaming machine. Most preferably, this side-mounted embodiment is storable, preferably in a collapsed and relatively less conspicuous position distal from the front of the machine.

Various embodiments can be made of resilient, relatively lightweight, and readily washable material. Particularly in the case of the removable embodiments, the trays are preferably washable in a conventional washing machine such as commercial washing machines.

The various trays disclosed herein may also be used in conjunction with removable hot or cold tray members and tray covers that may be removably mounted on a tray or tray mount and that will keep food cooler or hotter as desired until the tray cover is removed.

Certain embodiments disclosed within are also particularly economical, easy to manufacture, or advantageously utilized in the field.

There are other aspects of the present invention and the various disclosed embodiments. They will become apparent as the specification proceeds. In this regard, it is to be understood that the scope of the present invention is to be determined by the claims as issued and not by whether a given embodiment includes a given feature noted in this Brief Summary.

BRIEF DESCRIPTION OF THE DRAWINGS

The applicant's preferred embodiments are shown in the accompanying drawings wherein.

DESCRIPTION OF THE PREFERRED EMBODIMENTS

In the following detailed description of the preferred embodiments, reference is made to the accompanying drawings, which form a part of this specification. The drawings show, by way of illustration, specific embodiments. It is to be understood that other embodiments may be utilized and structural changes may be made without departing from the scope of the present invention.

This specification uses spatially orienting terms such as front, back, rearward, horizontal, etc. It is to be understood these types of terms are for ease of description of various components with respect to one another and do not define absolute orientations in space.

Figure 1:
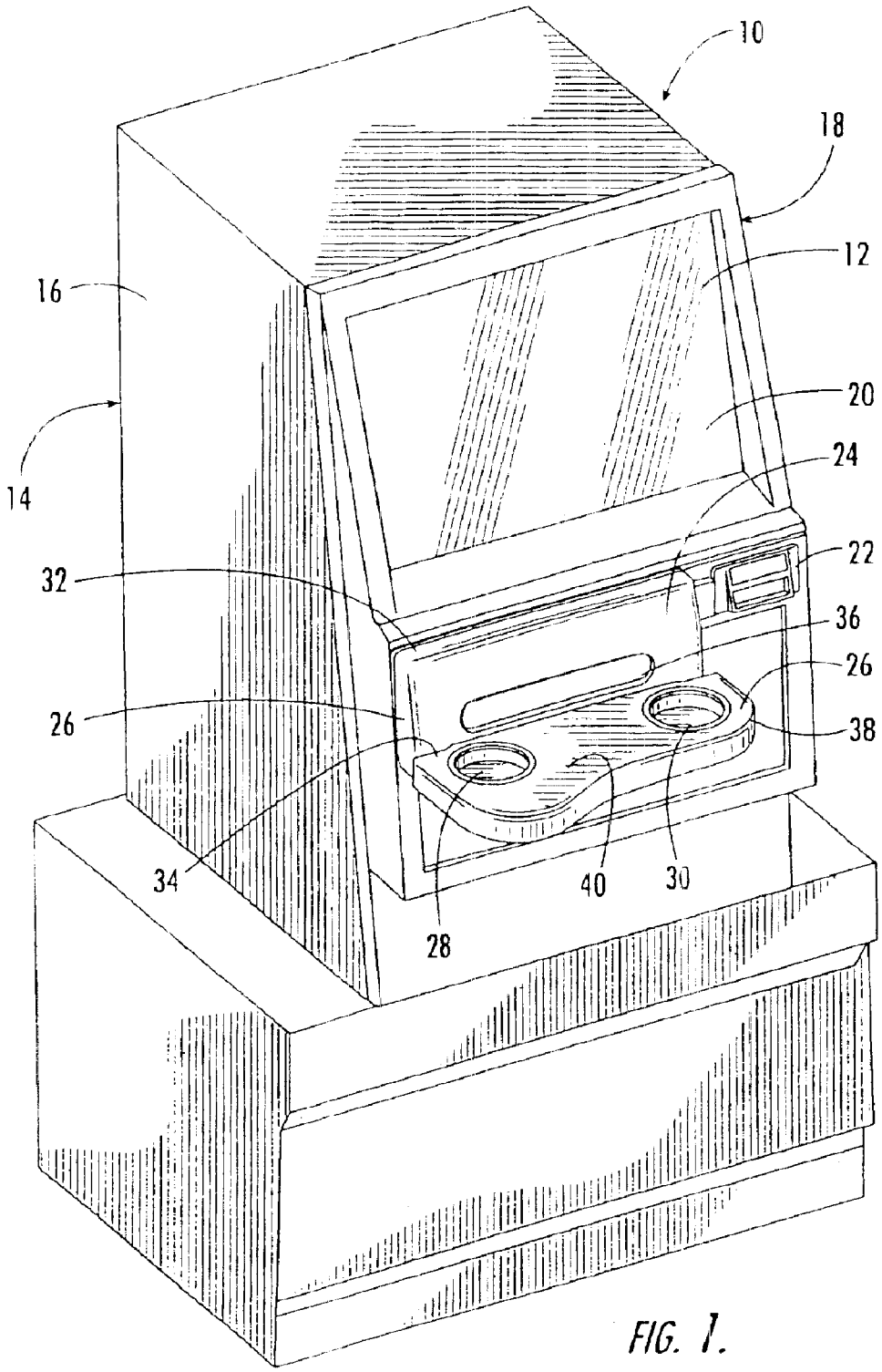
FIG. 1 is an isometric view of one embodiment of a food tray removably mounted on the front of a gaming machine.

With reference now to FIG. 1, a gaming machine 10 has a front side 12 opposite a back side 14 and two opposing sides 16, 18 extending between the front side 12 and back side 14. The front side 12 provides a user interface including a gaming display 20 and may include additional structures, such as coin input 22, other user-accessible devices, user-readable displays, or lighting, etc. A user or game player (not shown) may typically play a game at the gaming machine 10 by 15 standing or sitting relatively closely adjacent or in front of the front side 12 of the gaming machine 10. The game player can thereby insert coins into the coin input 22, view the gaming display 20, and operate controls or input devices on or adjacent the front side 12 of the gaming machine 10.

It is to be understand that, in this specification, that the term "gaming machine" means video game machines and gambling machines, such as slot machines, video games-of-chance, roulette machines, and the like. These machines are commonly located in casino and arcade commercial establishments and include a front side providing a gaming interface that the user or game player observes in order to play the gaming machine from, the tray abutting surface 46 on the tray mount slot 52.

Figure 3:
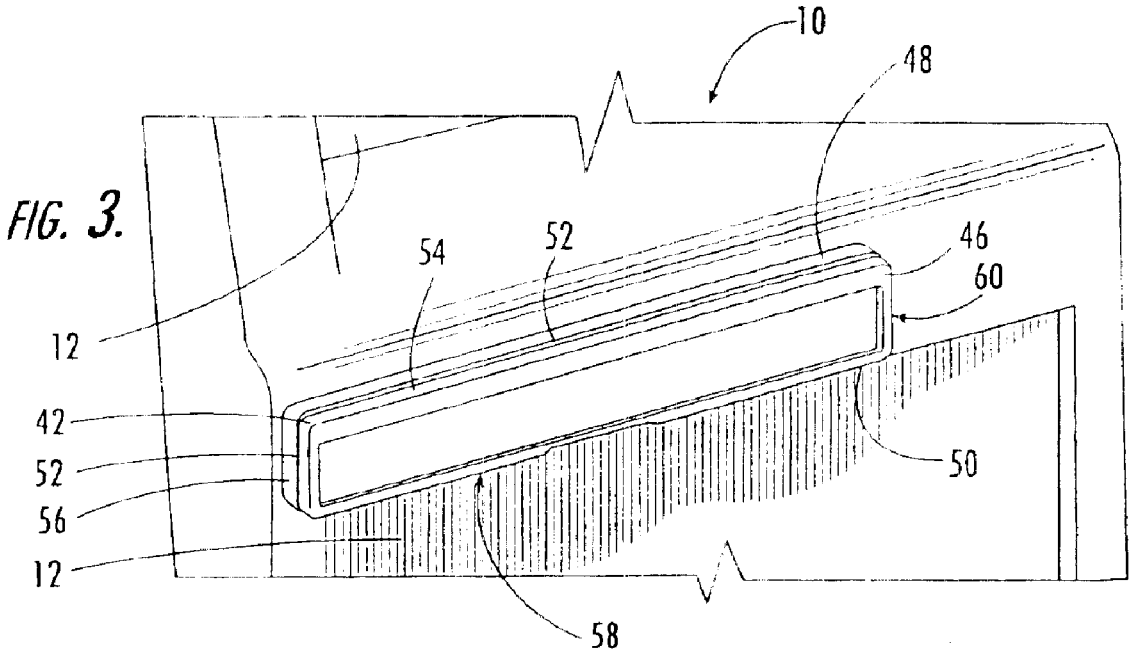
FIG. 3 is a partial isometric view of a gaming machine, showing a vertically oriented mount for a food tray.
Figure 4:
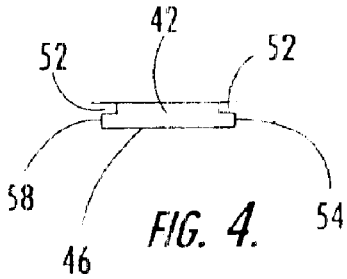
FIG. 4 is a side plan view of the mount shown in FIG. 3.
Figure 5:
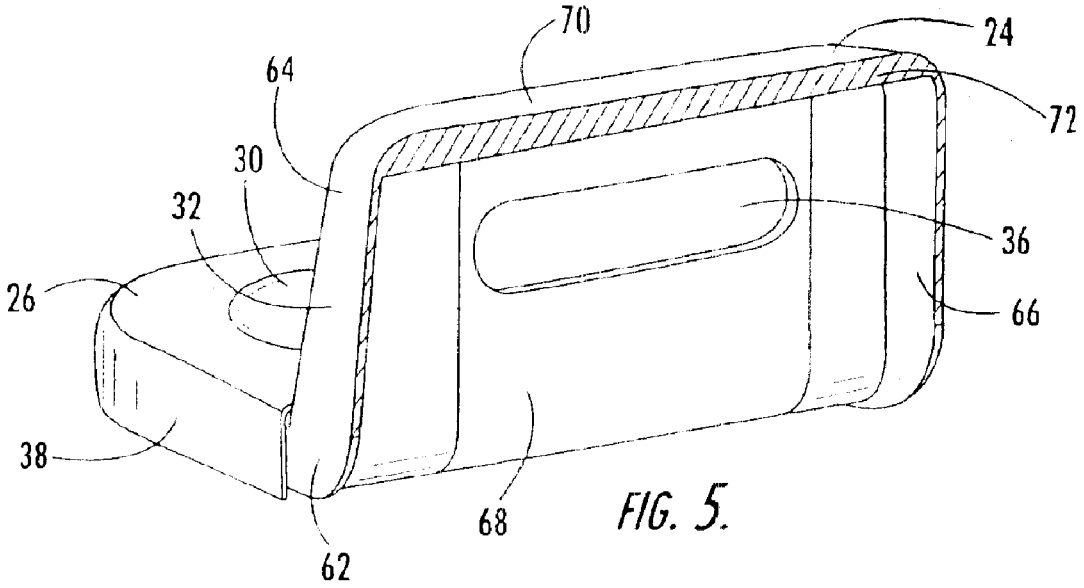
FIG. 5 is a rearward isometric view of the removable food tray shown in FIG. 4.

With reference now to FIG. 5, the food tray mount section 32 on the food tray 24 has a transverse arm section 62 extending below and abutting the lower side (not shown) of the upper support surface or tray member 26. The food tray mount section 32 also has two opposing planar sides 64, 66 extending perpendicularly from a generally planar central mount section 68 adapted to abut, as shown in FIG. 3, the tray mount abutting surface 46. As shown in FIG. 5, a horizontally extending upper edge 70 extends between the two opposing sides 64, 66 on the food tray mount section 32, and a generally planar slot mount section 72 also extends between the opposing sides 64, 66 abutting and perpendicularly extending from the opposing planar sides 64,66 and the upper edge 70. The slot mount section 72 is thus adapted to slidably and removably mount within, as shown in FIG. 4, the tray mount slot 52 on the tray mount 42.

In this fashion, the same food tray mount section 32 may be used with interchangeable tray mounts, such as mount 42, that may be removably mounted on the tray mount section 32. Differing tray mounts, e.g., 42, can have differing configurations, such as differing cup holders, such as cup holder detent 30, in differing locations or differently sized and configured food support sections, such as food support section 40 in FIG. 1.

The food tray 24 is preferably made of molded plastic, such as polystyrene. The food tray 24, is therefore lightweight, economical and easy to manufacture, relatively durable, rigid, and strong, and readily removable and washable, including in conventional washing machines. The food tray 24 may, however, be made of other or additional materials, including heavier materials, which can add further stability and rigidity to the location of the food tray on the associated gaming machine 10.

With continuing reference to FIG. 1, the gaming machine 10 includes a food tray 24 removably mounted on a tray mount (not shown in FIG. 1) on the front side 12 of the gaming machine 10. The removable food tray 24 has a generally planar upper support surface 26 extending parallel to the floor (not shown) that supports the gaming machine 10. An integral lip 38 extends perpendicularly downwardly from the upper support surface 26, lending rigidity to the upper support surface 26. The upper support surface 26 also includes first 28 and a second 30 cup-holder detents extending downwardly toward the floor from the planar upper support surface 26, and a food support section 40 extends intermediate the first and second cup-holder detents 28, 30. A food tray mount section 32 extends transversely upwardly from the upper support surface 26 at the back or rearward edge 34 of the upper support surface 26. The food tray mount section 32 includes a passage 36 that may be utilized as a handle in order to grasp and remove or mount the food tray 24 on the gaming machine tray mount and through which an underlying display, lighting, or graphic on the gaming machine 10 may be visible to the game player. The passage 36 may further be utilized to receive and mount additional trays (not shown in FIG. 1).

Figure 2:
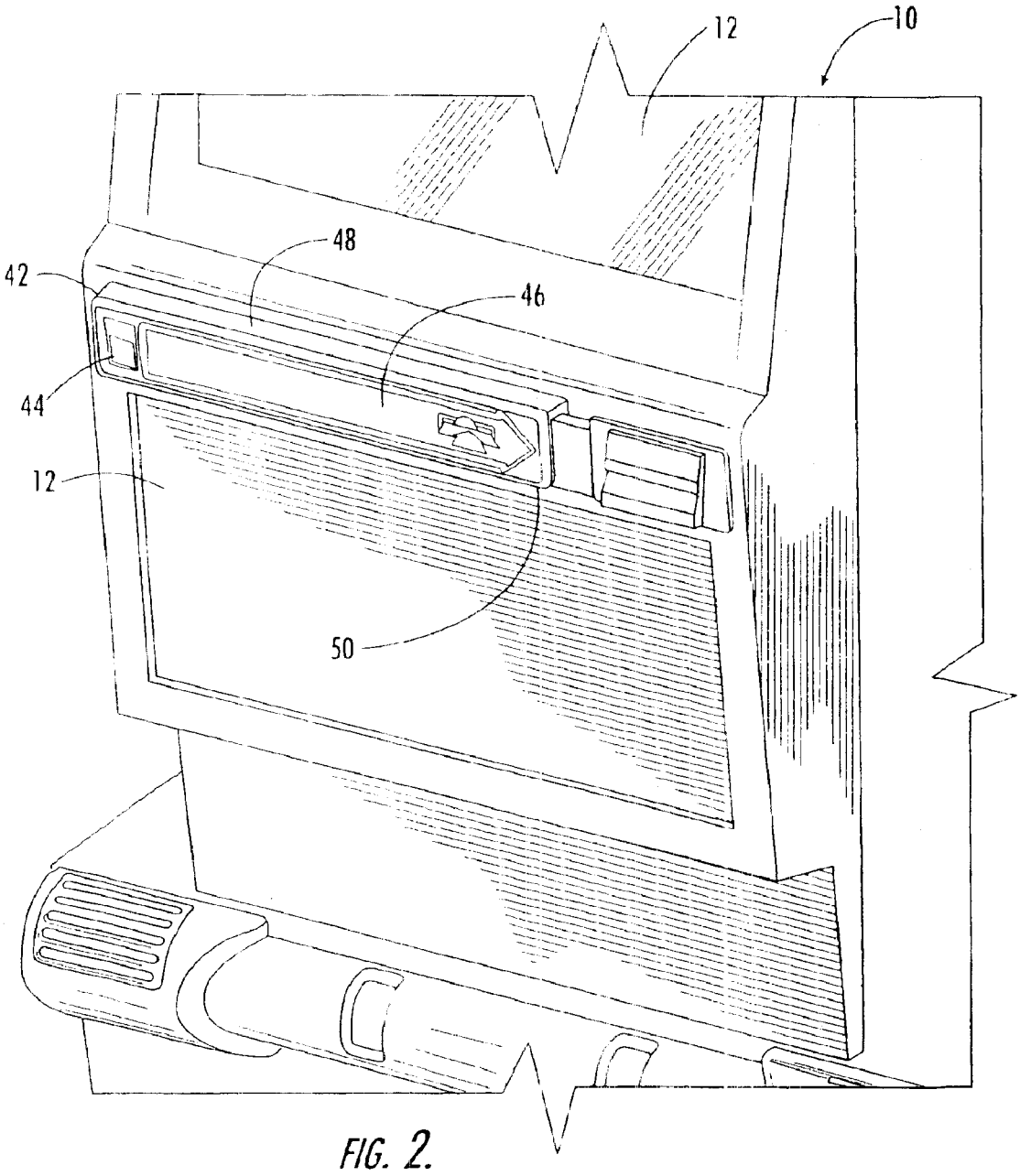
FIG. 2 is a partial isometric view of the gaming machine of FIG. 1, showing a decorative mount for the food tray.

With reference now to FIG. 2, the gaming machine's tray mount 42 projects outwardly from the gaming machine 10. The tray mount 42 extends horizontally across the front side 12 of the gaming machine 10 and may include graphics, labels, or gaming machine structures (e.g., 44) within the confines of a generally planar tray abutting surface 46 extending perpendicularly between the generally horizontal upper 48 and lower 50 edges of the tray mount 42. With reference now to FIGS. 3 and 4, the tray mount 42 includes a tray mount slot 52 extending around the peripheral sides 54, 56, 58, 60 of the tray mount 42 extending generally perpendicularly rearward from the tray mount tray abutting surface 46 The tray mount slot 52 is thus parallel to, but spaced rearwardly.

Figure 6:
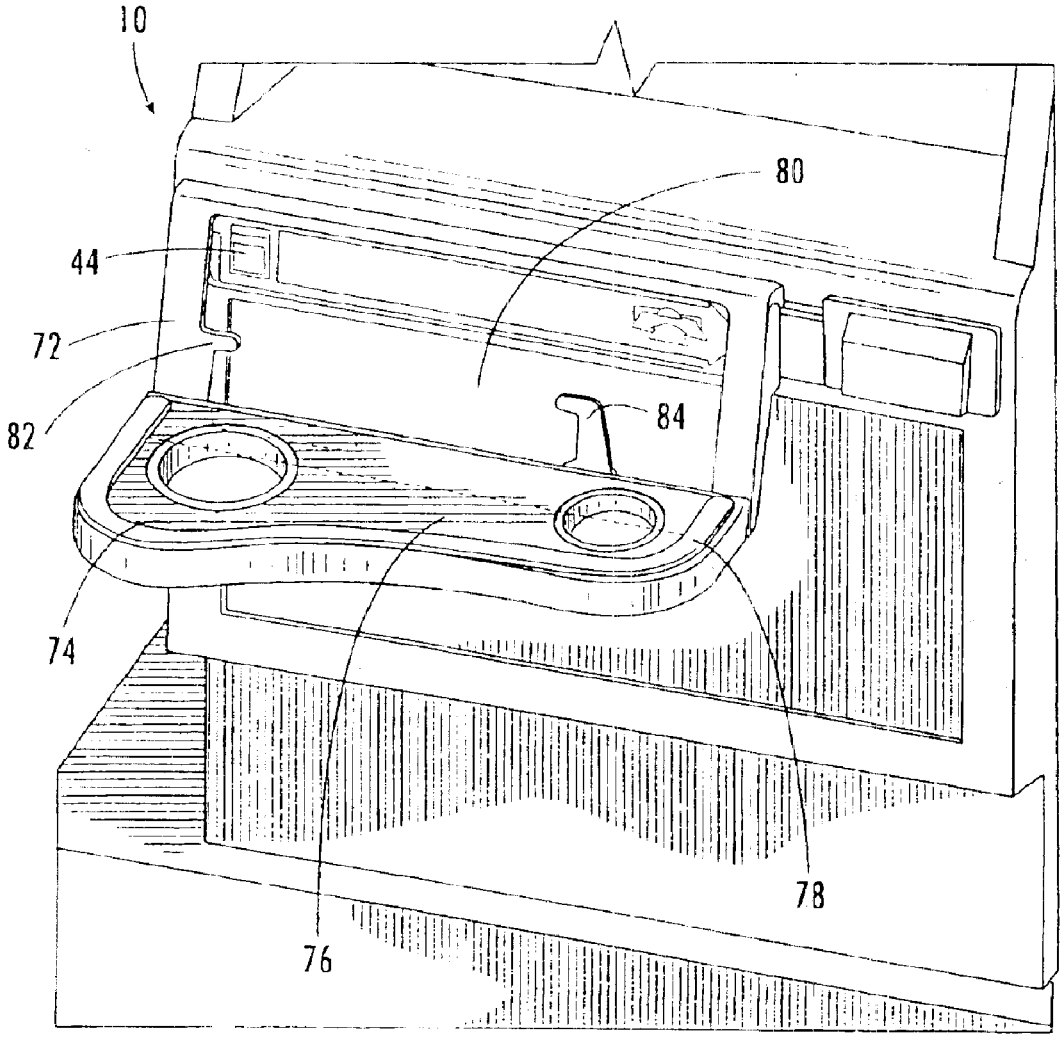
FIG. 6 is an isometric view of an alternative food tray removably mounted on the front of a gaming machine.

With reference now to FIG. 6, an alternative food tray mount section 72 supports an alternative upper support surface 74 on the gaming machine 10. The upper support surface 74 has a generally planar food support section 76 and a retaining ridge 78 extending upwardly from the food support section 76. The food tray mount section 72 has a central face section 80 that is preferably transparent or open to expose to a game player the structure, lighting, graphics, e.g., 44, underlying the food tray mount section on the associated gaming machine 10. Alternative upper support surface 74 is also preferably transparent. Central face section 80 and alternative upper support surface 74 may be made of transparent material, such as acrylic, crystal, fiber glass, or other polymers known in the art.

The food tray mount section 72 may have various projections, e.g., 82, 84, extending upwardly adjacent the central face section 80. These projections 82, 84 may provide braces or clamps for other food tray structures that may be mounted on or in association with the upper support surface 74.

Figure 7:
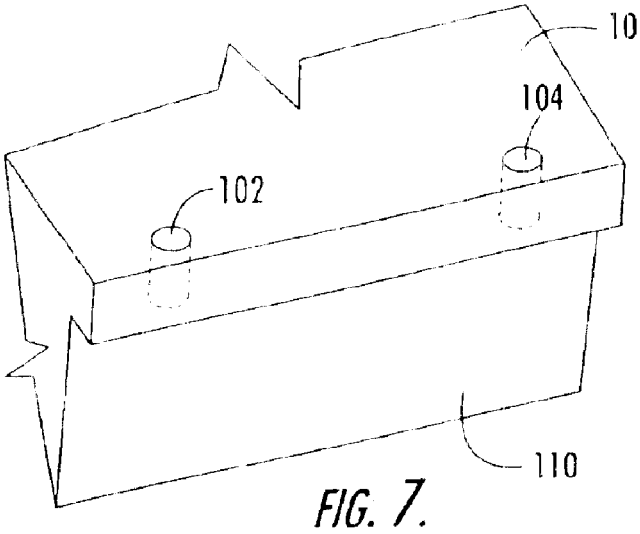
FIG. 7 is a partial isometric view of the front of a gaming machine having vertical passage mounts for a removable food tray.
Figure 8:
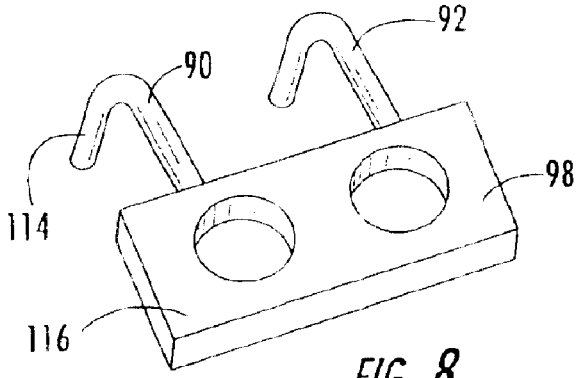
FIG. 8 is an isometric view of another alternative food tray having bent rod mounts for removably penetrating the passage mounts of the FIG. 7 gaming machine.
Figure 9:
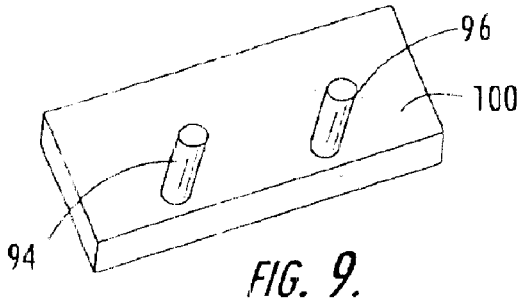
FIG. 9 is an isometric view of another food tray embodiment having straight rod mounts for removably penetrating the passage mounts of the FIG. 7 gaming machine.

With reference now to FIGS. 7–9, an alternative food tray mounting arrangement may utilize mounting rods of various configurations 90, 92 or 94, 96 extending from a base tray 98 or 100, respectively, in order to alternatively penetrate mating rod mount passages 102, 104 in the front side 110 of a gaming machine 10. In the embodiment shown in FIGS. 7 and 8, the mounting rods 90, 92 are bent to provide a mounting section 114 at perpendicular to the plane of the food tray upper surface 116. The mounting section 114 removably penetrates an associated vertical rod mount passage 102 in order to support the food tray upper surface 116 horizontally with respect to a floor (not shown). In the embodiment of FIG. 9, the mounting rods 94, 96 are straight and extend perpendicularly from the bottom surface 118 of the food tray 100 in order to removably penetrate the vertical rod mount passages 102, 104, respectively, to provide a horizontal orientation for the food tray upper surface (not shown).

Figure 10:
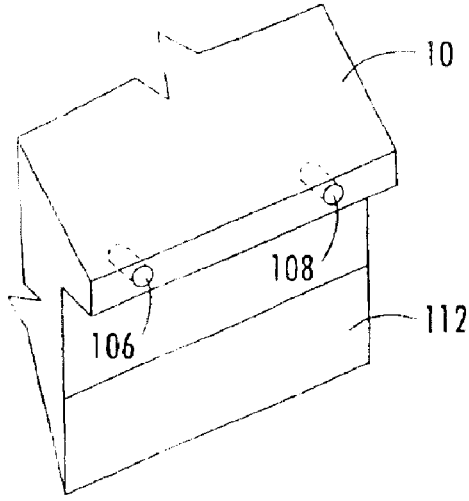
FIG. 10 is a perspective view of the front of a gaming machine having horizontal passage 20 mounts for a removable food tray.

Referring now to FIG. 10, the round mount passages 106, 108 maybe horizontal in order to mate with similarly designed mating mounting rods (not shown) on associated table trays (not shown) in order to removably mount the trays to the front side 112 of the gaming machine 10. The rod mount passages may be located at various other angles with respect to the floor (not shown) or the gaming machine front side 112 providing that the mounting rods may be similarly angled or adapted in order to removably penetrate the angled rod mount passages.

Figure 11:
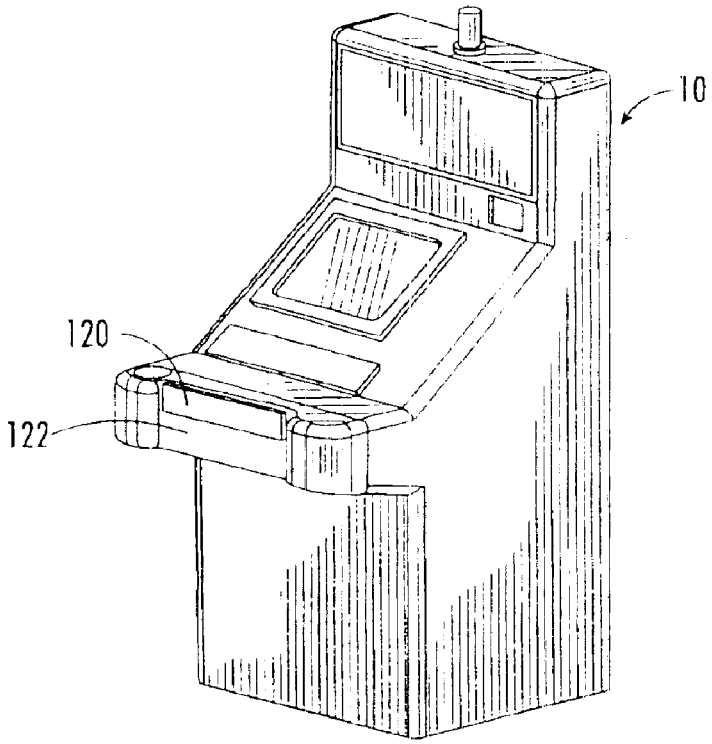
FIG. 11 is an isometric view of a video gaming machine having a front lip mount for a removable food tray.
Figure 12:
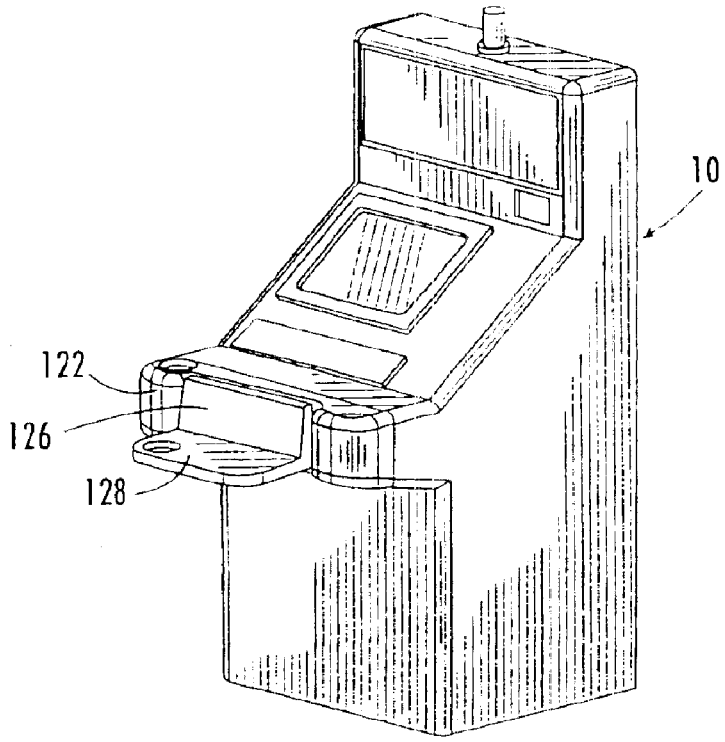
FIG. 12 is an isometric view of the gaming machine of FIG. 11 with another embodiment of a food tray removably mounted on the gaming machine.

Referring now to FIG. 11, an alternative food tray mount 120 is preferably attached to a slant top gaming device. The slant top gaming device provides a generally planar lip 124 extending upwardly and horizontally distal from the gaming machine 10 front side 122. As shown in FIG. 12, a generally vertically extending food tray mount section 126 may be removably mounted on the planar lip (not shown in FIG. 12) in order to support the associated food tray surface or section 128 horizontally with respect to the floor (not shown) and adjacent the front side 122 of the gaming machine 10.

Figure 13:
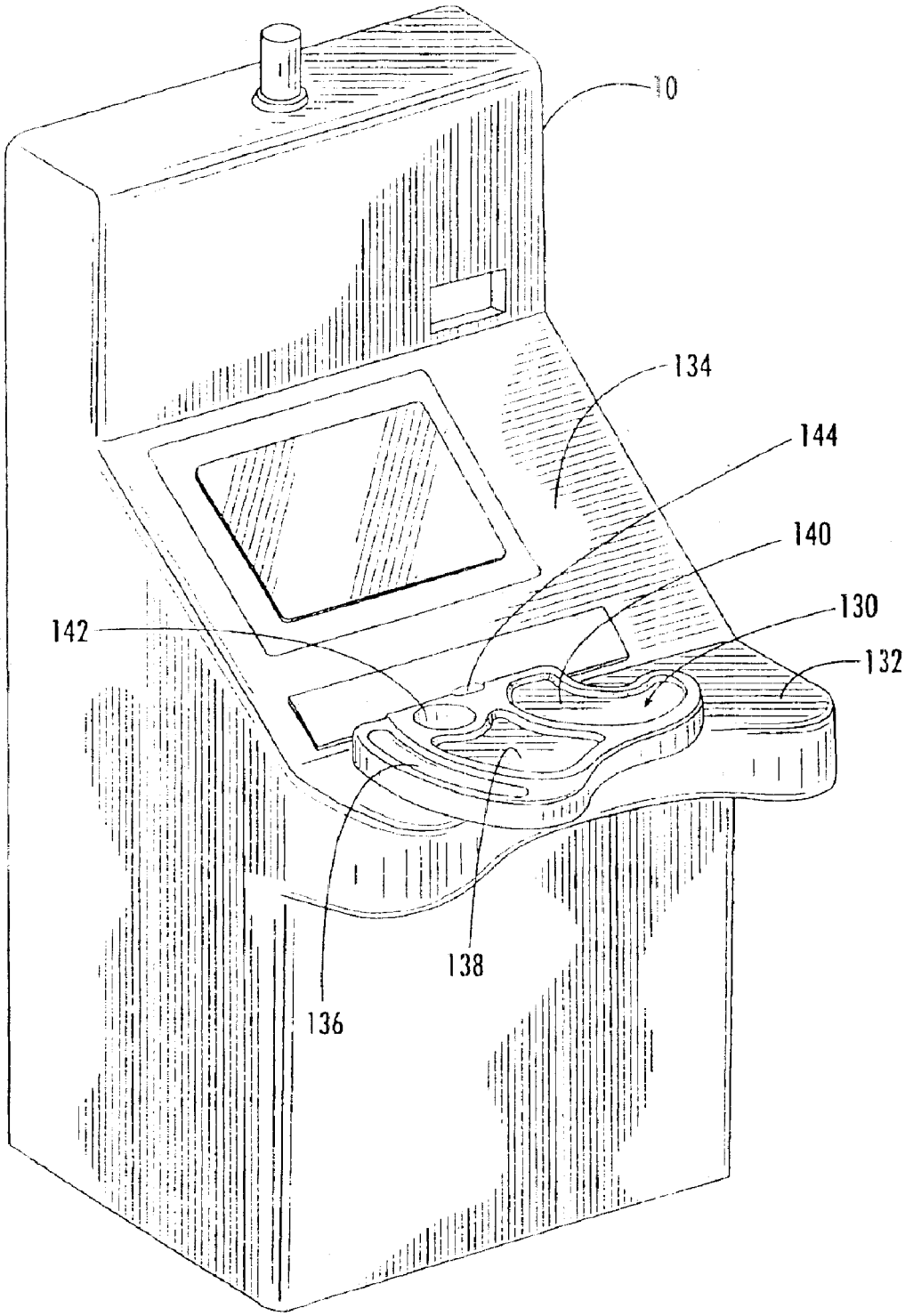
FIG. 13 is an isometric view of another video gaming machine with another embodiment of a food tray removably mounted on a horizontal surface extending from the front side of the gaming 5 machine.

With reference now to FIG. 13, a yet alternative arrangement of a removable food tray 130 on an associate gaming machine 10 rests on a generally horizontal gaming machine surface 132 extending from the front side 134 of the gaming machine 10. In the particular configuration of the food tray 130 shown in FIG. 13, the food tray 130 has multiple, varying configured food detents 136, 138, 140, 142 (one of which, e.g., 142, may be provide a cup holder) and amounting clip detent 144. The multiple food detents 136, 138, 140, 142 most preferably keep differing food or other items separated from each other on the food tray 130.

Figure 14:
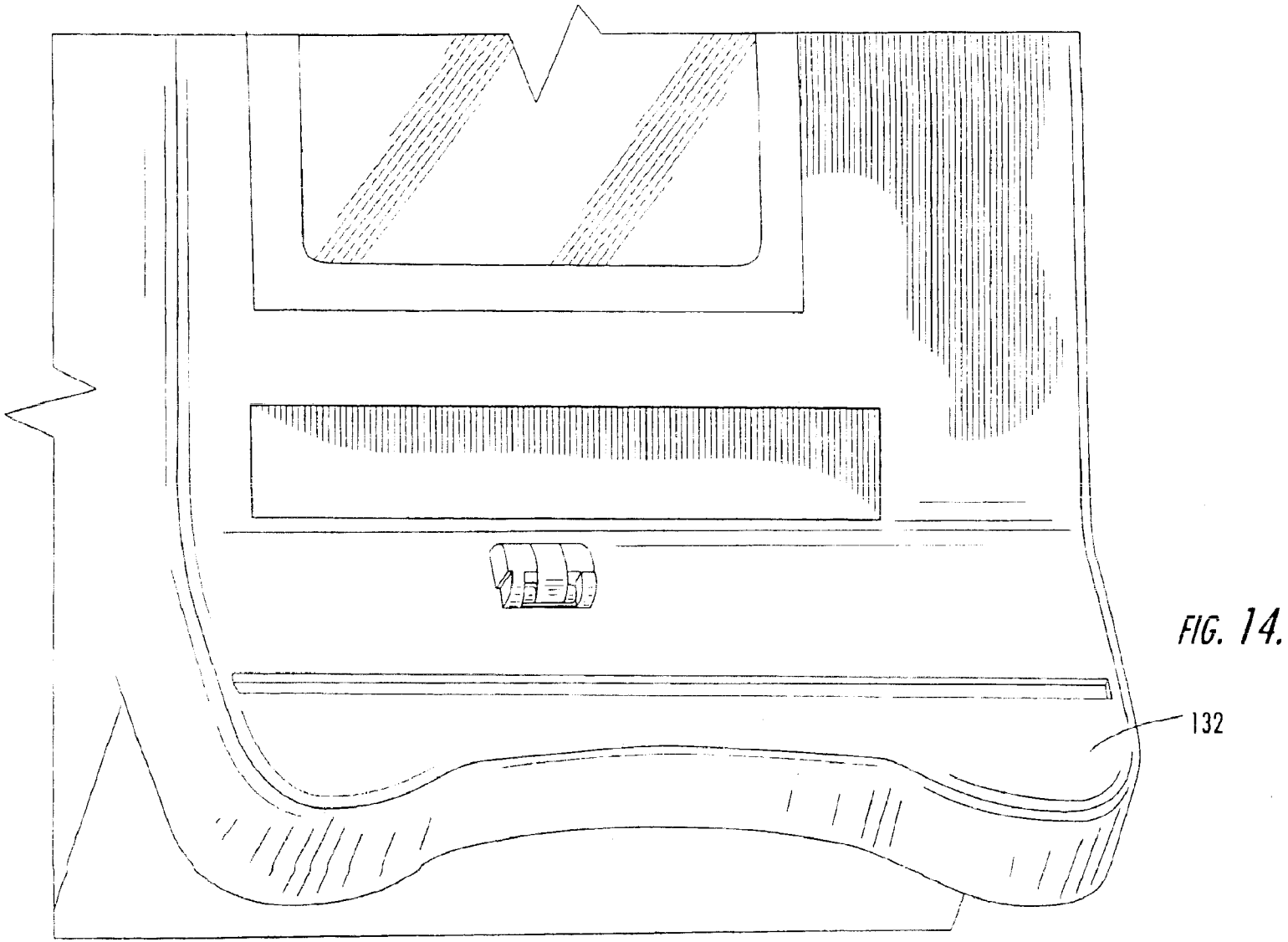
FIG. 14 is a partial isometric view of the gaming machine of FIG. 13 showing the decorative mounting clip for the food tray on the front-side horizontal surface on the gaming machine.

Referring now to FIG. 14, a food tray mounting clip 144 is secured to the horizontal gaming machine surface 132. The food tray mounting clip 144 can be used for gaming devices having an uneven front side or lip, such as the gaming devices shown in FIGS. 13 and 14. The mounting clip mates with, as shown in FIG. 13, the mounting clip detent 144 on the food tray 130 in order to removably secure the food tray 130 in position on the horizontal gaming surface 132. The food tray 130 is thus removed from the gaming machine 10 by clasping the mounting clip detent 144 with a finger and pulling the food tray 130 away from the food tray mounting surface 132.

The gaming machine surface 132 may have additional structures (not shown) such as detents that may mate with corresponding projections on the bottom side of a food tray (not shown) in order to further stabilized the food tray in position on the horizontal gaming surface 132. In the event that the gaming surface 132 is not horizontal, other structures may extend from and underneath the food tray in order to, most preferably, support the tray in a generally horizontal position with respect to the floor (not shown).

Figure 15:
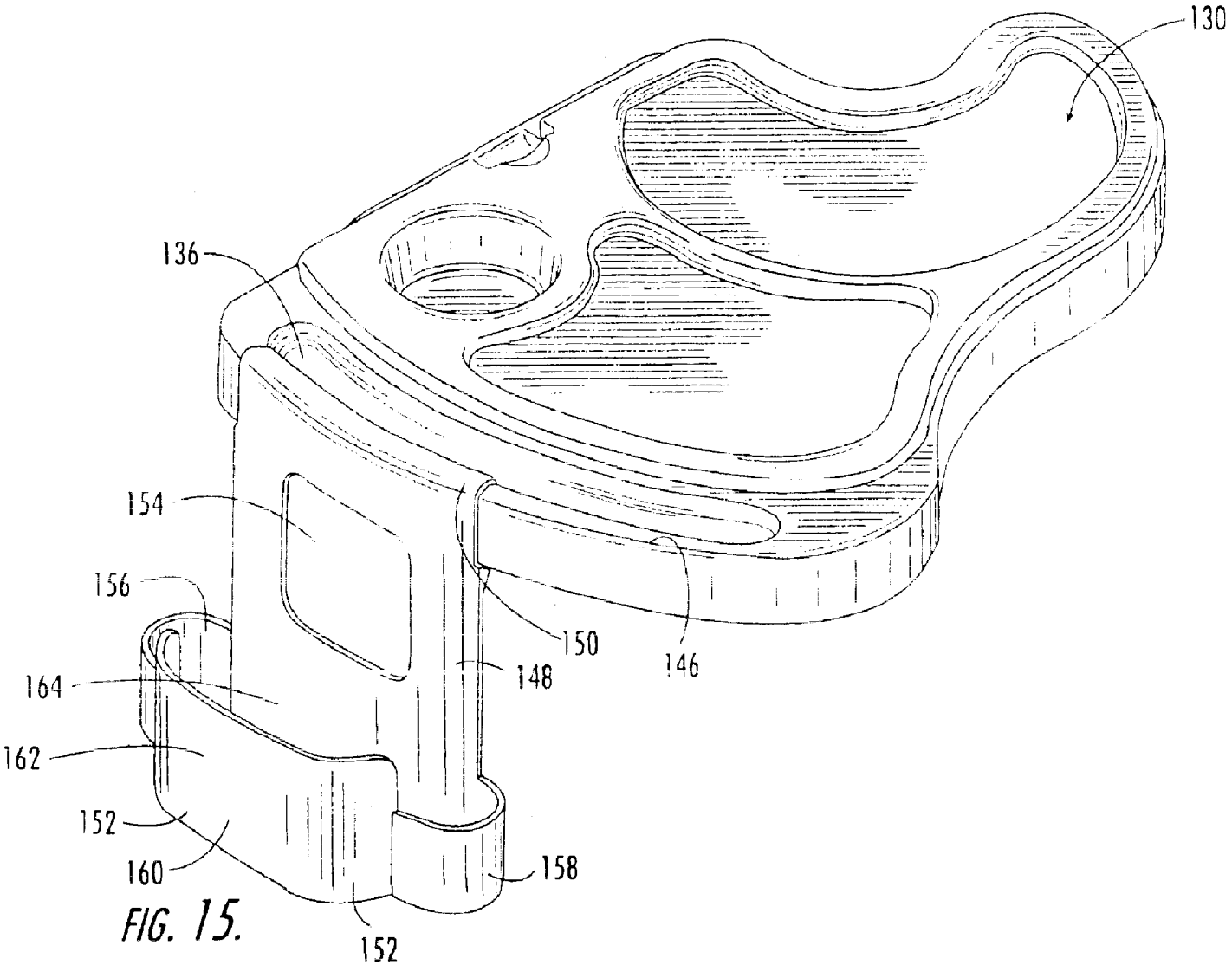
FIG. 15 is an isometric view of the removable food tray of FIG. 13 with a second tray 10 removably hung from a lip mount on the removable food tray.

With reference now to FIG. 15, the food tray 130 can optionally include a vertically or upwardly projecting second-tray mounting lip 146 integral with the boundary of a food detent 136. A second tray 148 may be removably hung from this mounting lip 146 by an upper hook or clasping section 150 integrally extending from a lower supporting tray section 152, which can extend outwardly or away from the food tray 130 to provide yet another tray section on which differing items can also be supported for use by the game player (not shown in FIG. 15) at a gaming machine (not shown in FIG. 15). The upper hook section 150 has an internal handle passage 154 for grasping and mounting or removing the second tray 148, and in the embodiment of FIG. 15, the supporting tray section 152 include two integral and opposing generally tubular support sections 156, 158, into which salt and pepper shakers (not shown) may be inserted. Intermediate the opposing tubular sections 156, 158 is an integral central supporting section 160, with generally planar opposing vertical side walls 162, 160, and in which other condiments, such as sweeteners (not shown) may be supported. This second tray 148 is preferably molded from plastic, such as polystyrene, in order to provide the same type of characteristics noted above for the alternative food tray of FIG. 1.

Figure 16:
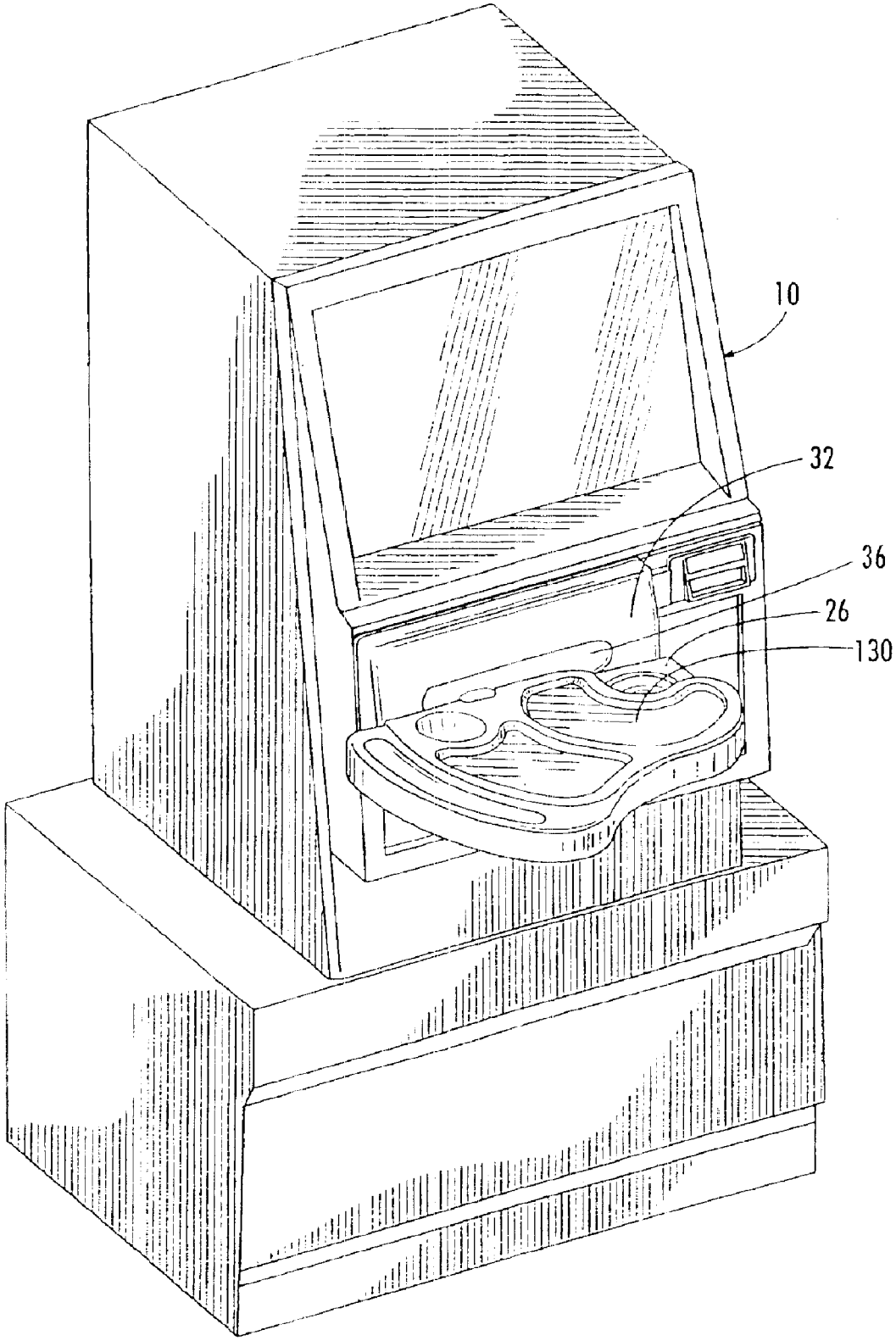
FIG. 16 is an isometric view the embodiment of the food tray of FIG. 13 mounted on the upper food tray mount section of FIG. 1.

Referring now to FIG. 16, the food tray 130 shown in FIG. 13 may also be adapted to be mounted on alternative gaming machine mounting structures, such as on the uppermost surface (not shown in FIG. 16) of the tray member 26 and on its associated food tray mount section 32 of FIGS. 1 and 5. In this fashion, the same food tray, e.g. 130, may be utilized as a food tray in association with differing gaming machines having differing food tray mounting devices and configurations. The same food tray 130 also may be used to alter the food (or other object) support configuration provided to a game player at the gaming machine 10. This arrangement further allows for use of differing types of food tray members, e.g., 130 in FIGS. 16 and 26 in FIG. 1, on the same type of machine, e.g., 10 in FIGS. 1 and 16, notwithstanding that one of the food tray members, e.g., 130 in FIG. 16, is also adapted for use on a differing type of gaming machine and food tray mounting arrangement, e.g., in FIG. 13.

Figure 17:
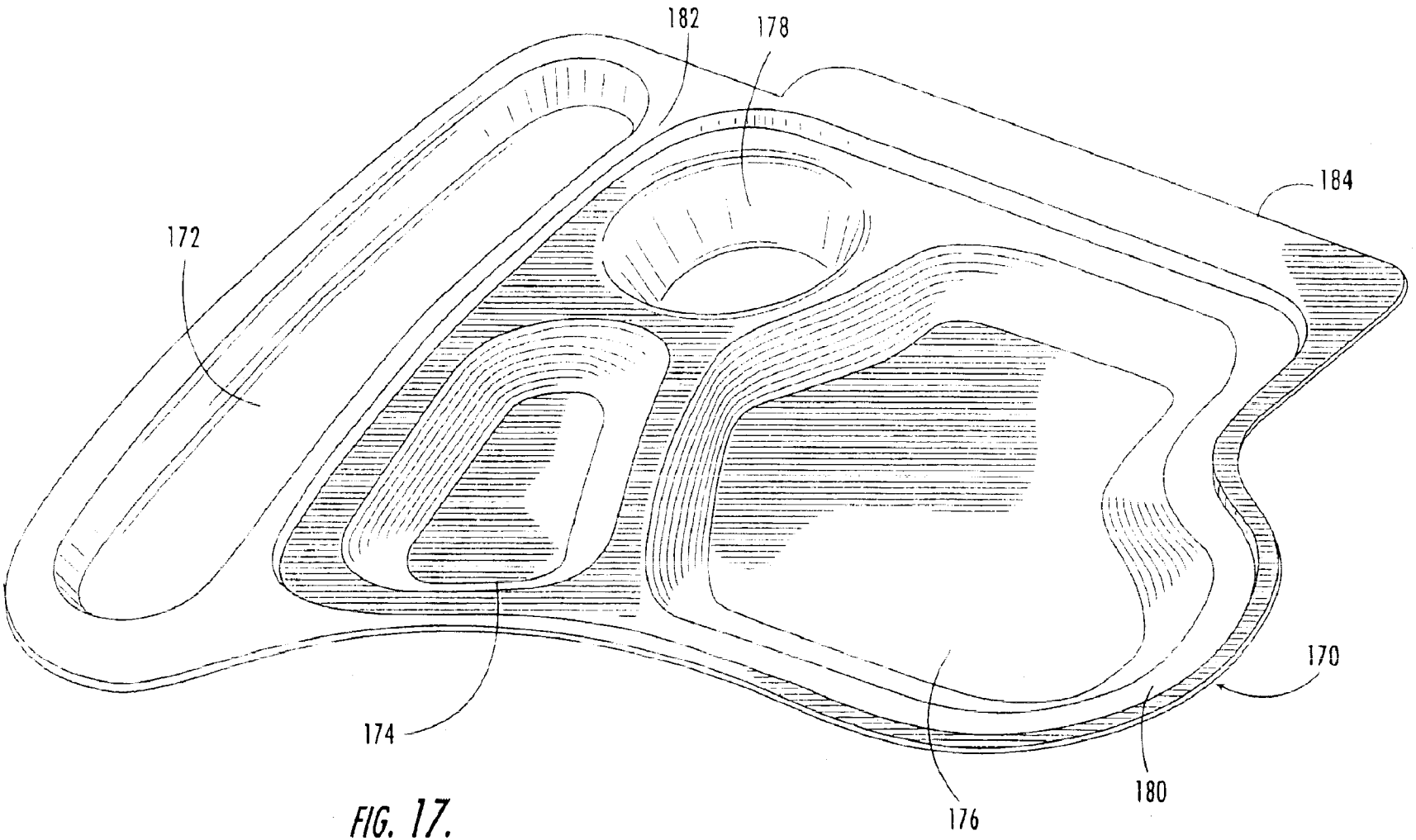
FIG. 17 is an isometric view of a removable tray having a rearward tray mounting tongue.

Referring now to FIG. 17, another embodiment of an easily hand-removable food tray 170 has a variety of yet differently configured detents or bowl-like depressions 172, 174, 176, and 178 (including a cup-holder 178). In addition, several of the bowl-like depressions 174, 176, and 178 are formed within an central surrounding depression 180 making it less likely for food that spills within these several food detents 174, 176, and 178 to spill over into the depression having a raised upper surface 182 with respect to the relatively lower surface provided by the common surrounding depression 180. The raised upper surface 182 in turn surrounds the central surrounding depression 180 at a level raised above the central surrounding depression 180, and the rearward portion of the raised upper surface 182 provides a planar, rearwardly extending tongue mounting section 184. The tongue mounting section 184 is adapted to, if desired, slidably and removably mount within a mating surrounding slot (not shown) on an associate gaming machine (not shown in FIG. 16).

Figure 18:
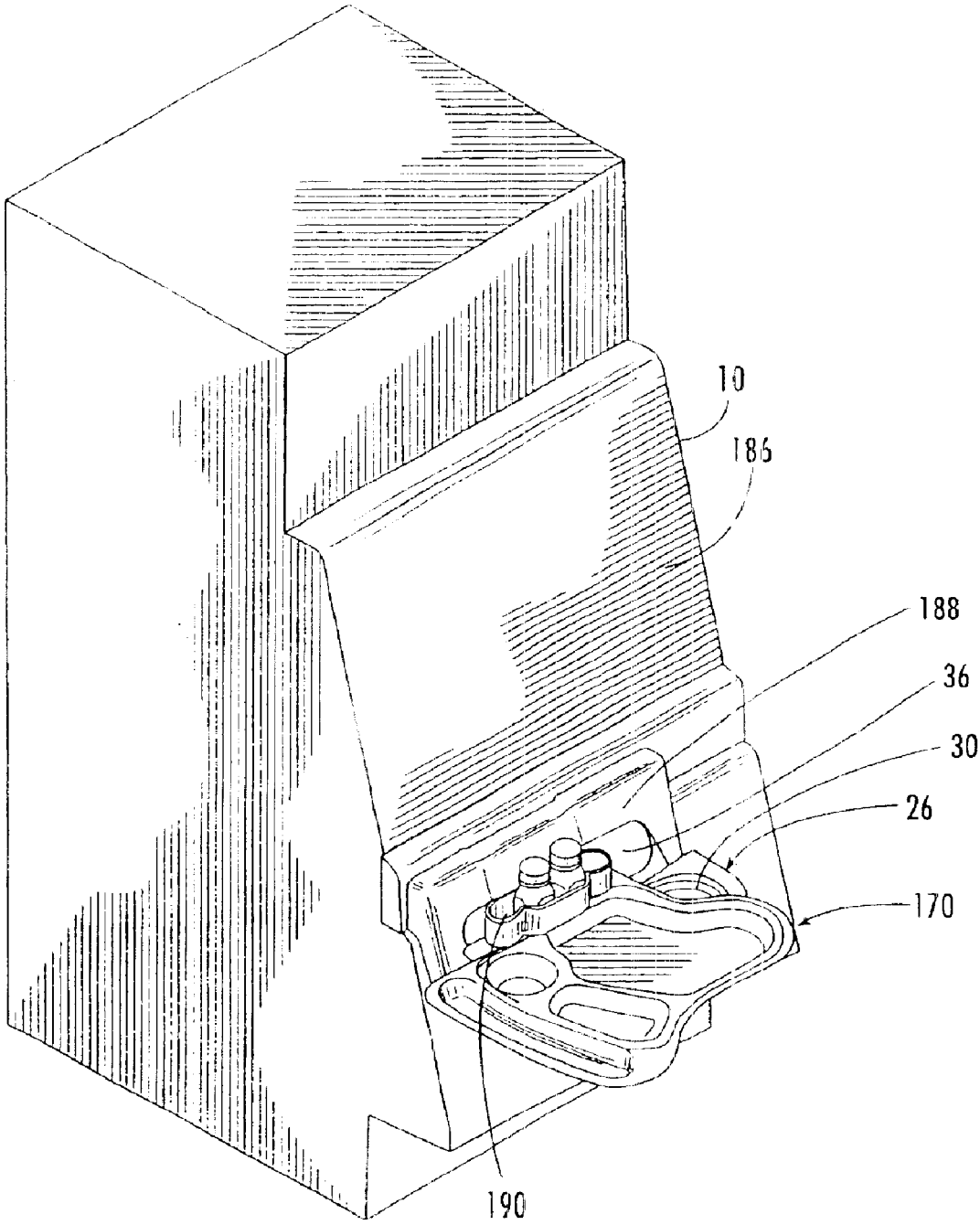
FIG. 18 is an isometric view of a gaming machine of FIG. 17 with three trays, including the tray of FIG. 17, removably mounted serially, one on top of another, to provide a three level, high capacity food tray arrangement.

With reference now to FIG. 18, the food tray 170 of FIG. 16 may also mounted in a mating mounting structure 188 mounted on the front face 186 of the gaming machine 186. The mounting structure 188 can include a removable mounting element 188 removably mounted on a mounting slot (not shown) on the machine 10 in somewhat the same way the food tray mount section 32 of FIG. 1 is mounted on the associated gaming machine 10 in FIG. 1. The food tray 170 may rest on top of an underlying food tray such as food tray 26 shown in FIG. 1. A separate removable condiments tray 190 may also be removably mounted on the tongue mounting section 184 of the food tray 170 in order to secure the food tray 170 and condiment tray 190 in position with respect to the mounting structure 188 on the gaming machine 10. In this fashion, the underlying tray 26 provides both a tray support structure for the upper Food tray 170 and a drink holder (not shown) for example. The upper food tray 170 expands the food supporting capability of the underlying tray 26 by itself as shown in FIG. 1. he condiments tray 190 provides even further food (or other item) supporting capability to the overall structure provided on the front side 186 of the gaming machine 10 by this flexible, removable, and adaptable set of trays, 26, 170, 190 and associated support structures on the gaming machine 10.

Figure 19:
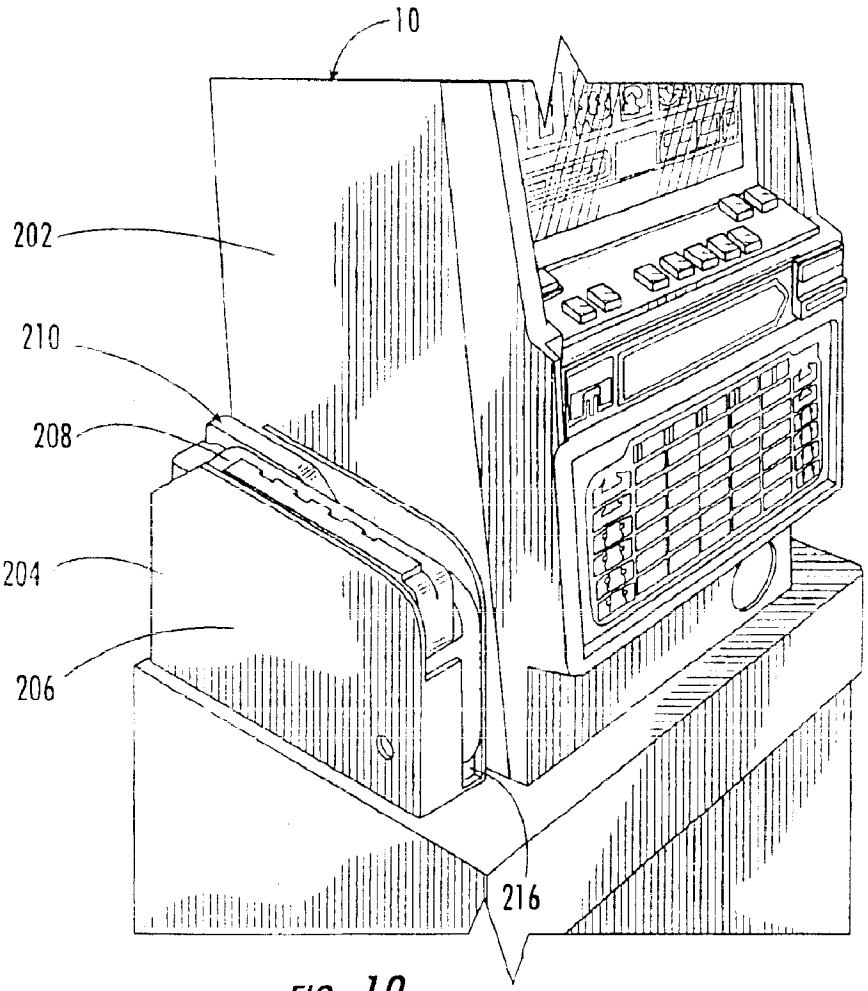
FIG. 19 is a partial isometric view of a gaming machine having a side-mounted tray in the collapsed and stored position adjacent the side of the gaming machine.

With reference now to FIG. 19, a collapsible embodiment of a support tray 200 is mounted on the side 202 of a gaming machine 10. The collapsible support tray 200 consists of a tray housing 204 secured adjacent the gaming machine's side 202, and tray 208 and tray support components, generally 210, collapsible into the confines of the tray housing 204. In the collapsed and stored position of FIG. 19, the collapsed support tray 200 is neatly stored out of the way of gaming players and others who may be in the vicinity of the gaming machine 10.

Figure 20:
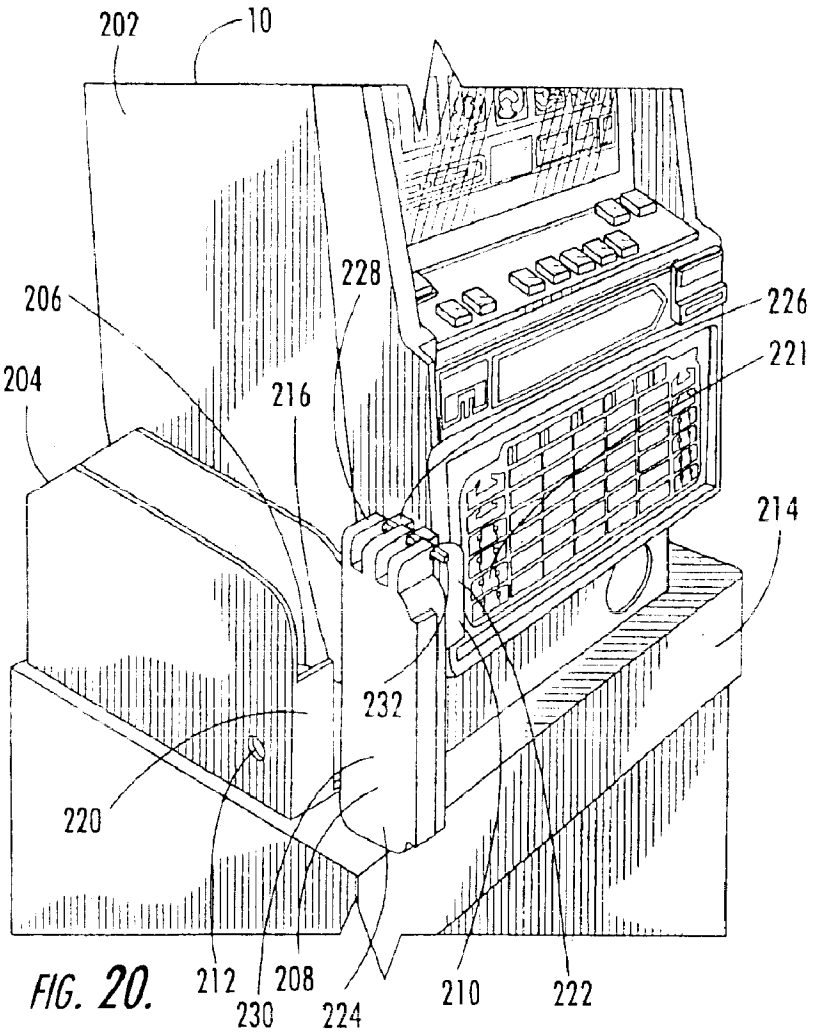
FIG. 20 is a partial isometric view of the gaming machine of FIG. 21 with the side-mounted tray rotated away from the side of the gaming machine into a partially opened position.

With reference now to FIG. 20, the tray 208 and tray support components 210 may be grasped manually and rotated out of the confines of the tray housing 204. This is accomplished by means of an L-shaped support arm 206 rotatably mounted about a pin 212 penetrating the tray housing 204 horizontally and parallel to the gaming machine's front side 214, and perpendicular to the side 202, of the gaming machine 10. The support arm 206 is planar and rotatable about the pin 212 in a plane parallel to the side 202 of the gaming machine 10 adjacent the side 202. The support arm 206 is thereby rotatable from a position within the confines of the tray housing 204 through a vertical support arm slot 216 in the front planar, vertically-extending side 220 of the tray housing 204 to an expanded position, in which one arm 218 of the L-shaped support (not shown in FIG. 20) extends vertically upwardly externally of the tray housing 204 spaced laterally from the side 202 of the gaming machine 10 as well as forwardly from the adjacent portion 221 of the front side 214 of the gaming machine 10.

The L-shaped support arm thus supports a generally co-planar, vertically extending tray support section 222, which in turns supports a collapsed two-piece tray 224 rotatably secured at its upper end 228 to the upper-end 226 of the tray support section 222. In this regard, a first tray section 230 of the collapsed two-piece tray 224 has a slotted upper end 228 that extends transversely to the predominant plane of the first tray section 230 to intersect and penetrate the matingly slotted upper end 226 of the tray support section 222. A horizontal pin 232 transversely penetrates the intersecting portions of the slotted upper ends 226, 228 so that the first tray section 230 is rotatable around pin and the upper end 226 of the vertically extending tray support section 222 in a plane generally parallel and adjacent to the front side or face 214 of the gaming machine 10.

Figure 21:
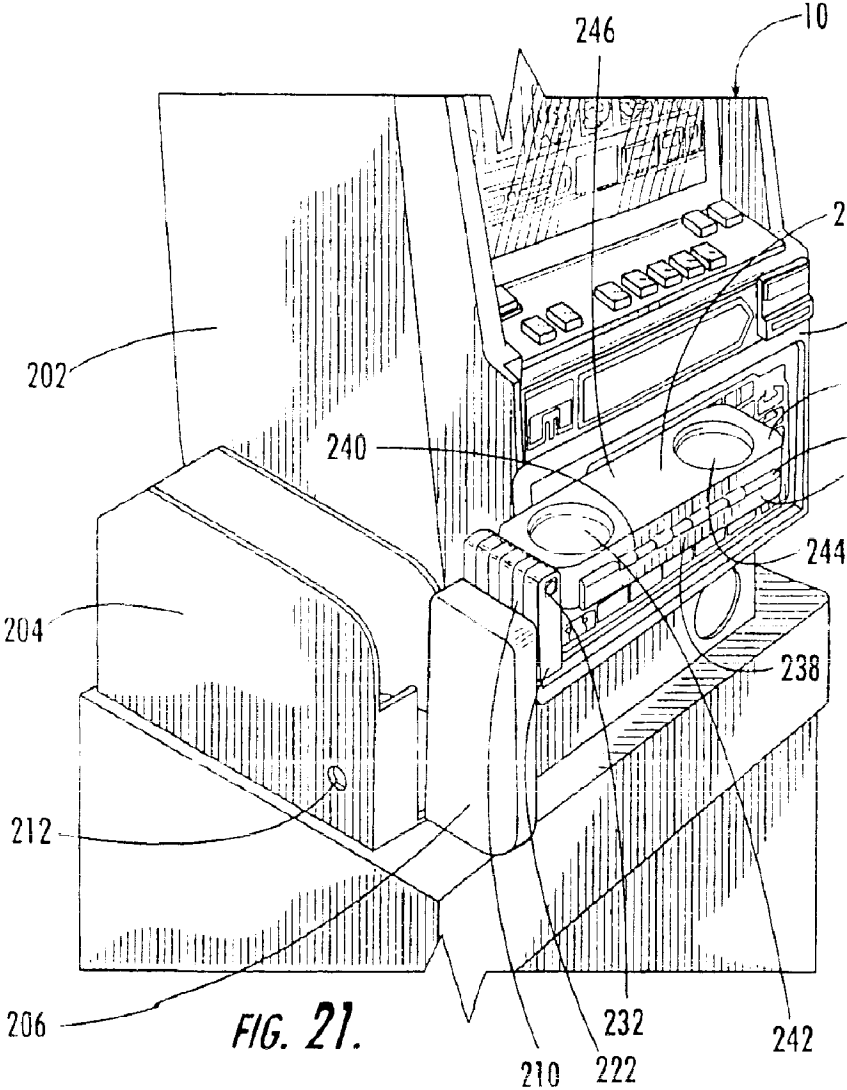
FIG. 21 is a partial isometric view of the gaming machine of FIG. 21 with the side-mounted tray away from the side of the gaming machine and upwardly into a further opened position adjacent the front of the gaming machine.

Referring now to FIG. 21, the two-piece tray 224 is rotatable from a collapsed vertical position (as shown in FIG. 20) to a horizontal, partially opened position adjacent the front side 214 of the gaming machine 10. In this partially opened position, the first tray section 230 of the tray 224 lies below and supports the second tray section 234, and a horizontal hinge 236 secures the outer edge 238 of the first tray section 230 to the outer edge 240 of the second tray section 234. The two piece tray 224 is maintained horizontally by the vertical outside edge (not shown) of the first tray section 224—the edge of the first tray section 224 perpendicular to the gaming machine's front side 214 adjacent tray support section 222—abutting a mating vertical outside edge (not shown) of the tray support section 222. In the partially opened position of FIG. 21, the second tray section 234 may have multiple cup-holder detents 242, 244 spaced from each other by an intermediate planar supporting section 246 on which other items may be supported, such as food.

Figure 22:
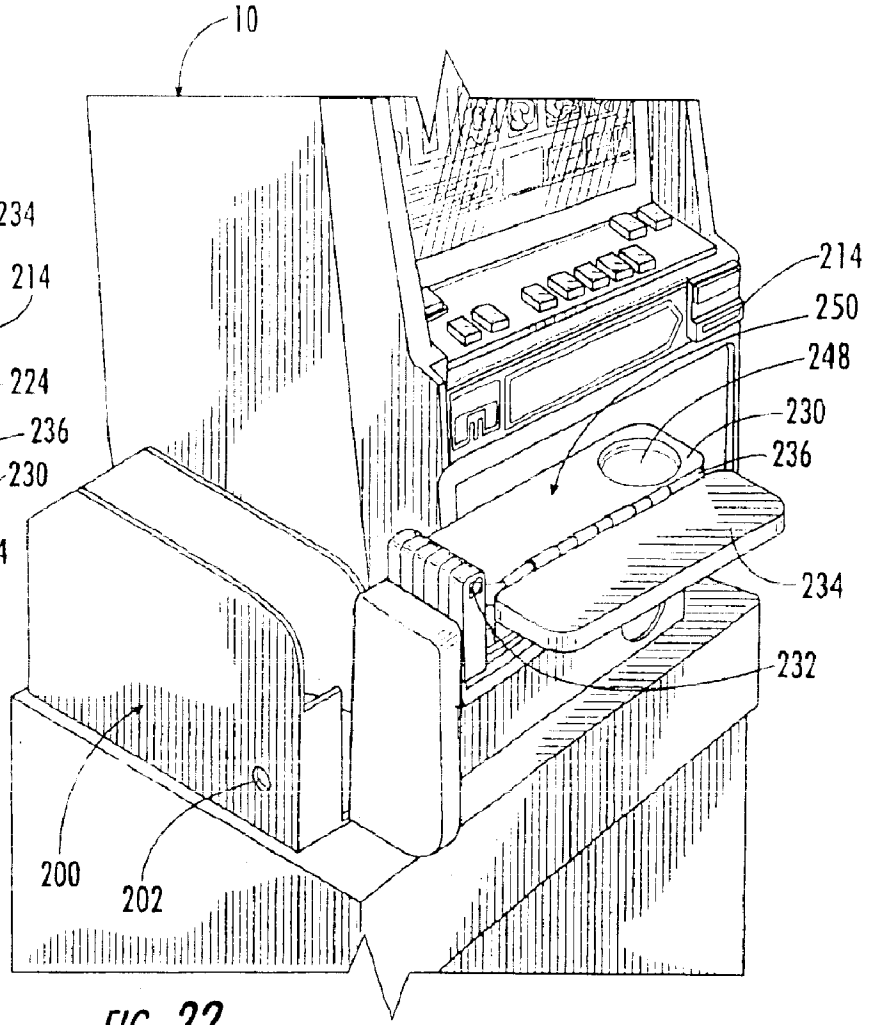
FIG. 22 is a partial isometric of the gaming machine of FIG. 21 with the side-mounted tray in a fully opened position adjacent the front of the gaming machine.

The tray configuration may be expanded and altered by, as shown in FIG. 22, fully opening or expanding the two-piece tray 224. In this position, the second tray section 234 has been rotated 180° about the hinge 236 so that the generally planar outer edge 238 (not shown in FIG. 22) of the first tray section 230 perpendicularly abuts the generally planar outer edge 240 (not shown in FIG. 22) of the second tray section 234. In this fully opened position, the horizontal two-piece tray may provide one or cup holders, e.g., 248, as well as other coplanar expanded support surface area 250 provided by the first and second tray sections 230, 234 adjacent the front side 214 of the gaming machine 10. In this position, the tray 224 will generally be intermediate a game player (not shown) and the machine and provide a surface on which the player may store and easily reach various items, such as food and other consumables.

The components of the collapsible tray 200, except the metal pins 212, 232 and hinge 236, are preferably made of a strong, resilient, durable, and easily washable but lightweight molded plastic, such as polystyrene. Other materials, such as wood or composites, may of course be used to make these components or various parts of them.

Figure 23:
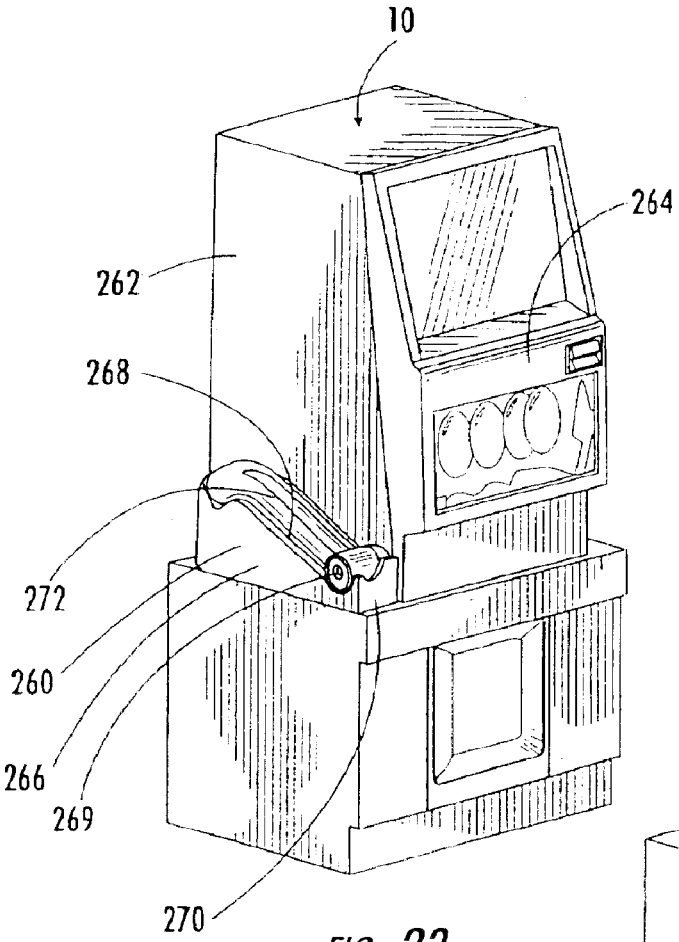
FIG. 23 is an isometric view of a gaming machine with a rotatable tray mount arm in a collapsed and stored position adjacent the side of the gaming machine.

With reference now to FIG. 23, another embodiment of a collapsible tray mount 260 is also secured adjacent a side 262 of a gaming machine 10 generally perpendicular to the front side 264 of the gaming machine 10. In the collapsed position of FIG. 23, the tray mount 260 is neatly tucked and stored out of the way of the front side 264 of the gaming machine 10 and persons who may be moving past or in the vicinity of the gaming machine 10.

The collapsible tray mount 260 consists of a support arm mount base 266 supporting a horizontal hinge pin 269, perpendicular to the rearwardly extending side 262 of the gaming machine 10, adjacent the front side 270 of the mount base 266 closest to the front side 264 of the gaming machine 10. The mount base 266 has an upper arm rest surface 268 sloping upwardly from the front side 270 of the tray mount 270 to the back side (not shown) of the gaming machine 10. A support arm 272 is rotatably secured about the hinge pin 269 to rest in a collapsed, upwardly sloped position abutting the matingly configured upper armrest surface 268 adjacent and parallel to the side 262 of the gaming machine 10.

Figure 24:
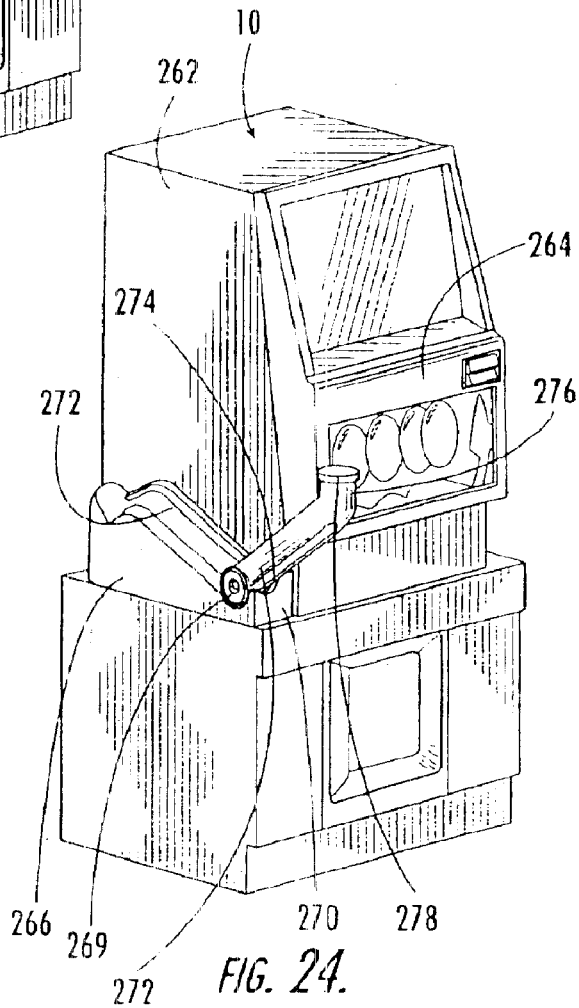
FIG. 24 is an isometric view of the gaming machine of FIG. 25 with the rotatable tray mount arm rotated into an open position extending from the side of the gaming machine past the front side of the gaming machine.

With reference now to FIG. 24, the support arm 272 has been rotated by a little more than 90° about the hinge pin 269 to an opened, tray supporting position. The support 272 has a generally cylindrical outer periphery, which abuts a matingly curved upper stop edge 274 on the front side 270 of the support arm mount base 266. The upper stop edge 274 thus supports the support arm 272 in its tray supporting position, and the support arm 272 has an angled upper cylindrical end section 276, with a generally planar (and in this position, horizontal) uppermost end 278, which is thereby maintained in a generally vertical orientation spaced from both the front side 264 and the rearwardly extending side 262 of the gaming machine 10.

Figure 25:
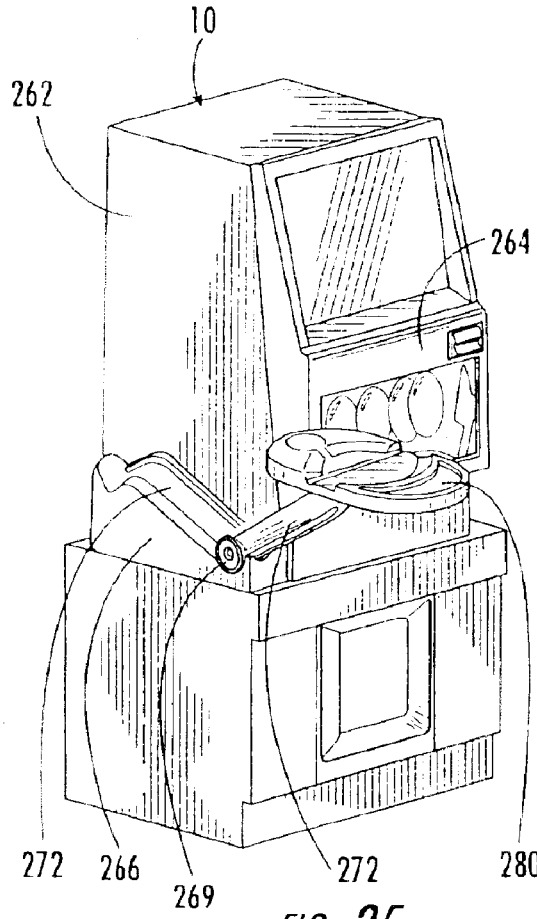
FIG. 25 is an isometric view of the gaming machine of FIG. 26 with a rotatable food tray 10 removably mounted on the tray mounting end of the rotatable tray mount arm.

With reference now to FIG. 25, an oblong food tray 280 is removably mounted on the support arm 272 to rest on the uppermost end 278 (not shown in FIG. 25) of the support arm 272. The food tray 280 thus has mounting detent (not shown) that matingly abuts and surrounds the uppermost end 278 of the upper cylindrical end section (not shown in FIG. 25) to removably secure the food tray 280 in a horizontal position spaced from, but somewhat adjacent, both the front side 264 and the rearwardly extending side 262 of the gaming machine 10. In this position, the oblong food tray 280 is oriented with its longest length perpendicular to the plane of the front side 264 of the gaming machine 10, and therefore the oblong food tray 280 may be located either in front of the gaming player (not shown) or to the side of the gaming player, depending on how directly the gaming player is standing in front of and close to the front side 214 of the gaming machine 10.

Figure 26:
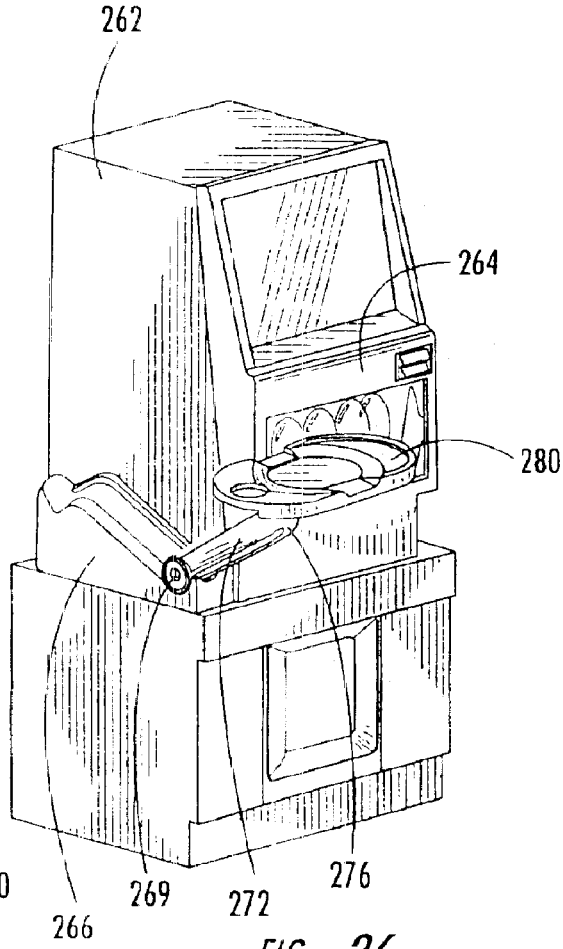
FIG. 26 is an isometric view of the gaming machine of FIG. 27 with the food tray rotated on the mount arm so that the at least a portion of the food tray extends more closely adjacent the front side of the gaming machine.

With reference now to FIG. 26, the oblong food tray 280 is horizontally rotatable on the cylindrical support arm 272 to rotate 90° from the position of FIG. 25 to that of FIG. 26, in which the longest length of the oblong food tray 280 is parallel to the plane of the front side 264 of the gaming machine 10. In this position, the food tray 280 is more directly in front of the gaming machine's front side 264 and possibly more easily reachable or directly in front of, or to the side, of the game player (not shown) as desired.

Figure 27:
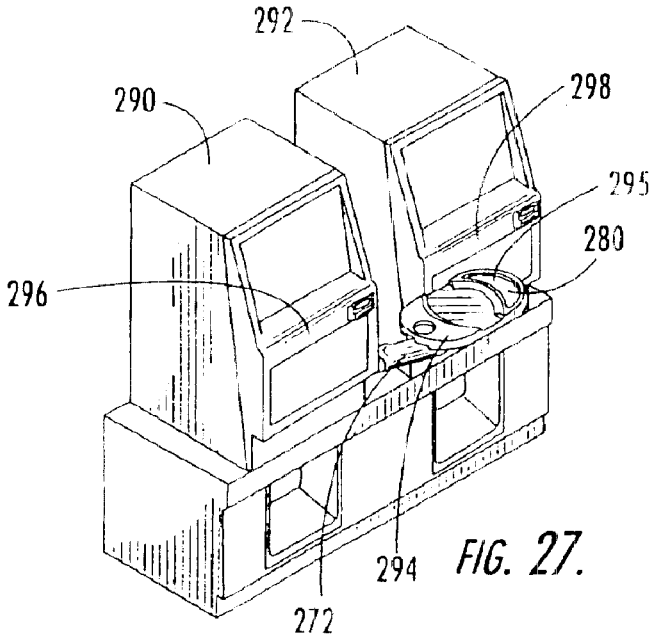
FIG. 27 is an isometric view of two side-by-side gaming machines with a rotatable food 15 tray and tray mount mounted between the two machines and with a collapsible mount arm rotated into a tray support position between the two gaming machines.

With reference now to FIG. 27, plural gaming machines, e.g., 290, 292, maybe mounted side by side each other. The collapsible tray mount and associated tray supporting structures, e.g., 272, described in connection with FIGS. 25 and 26 above may be mounted between two such machines 290, 292. The same type of oblong (or other) food tray 280 may be utilized to orient food tray support surfaces 294, 295 on the one tray 280 simultaneously adjacent the front sides 296, 298, respectively, of the two machines 290, 292.

With reference now to FIGS. 23–27, the collapsible tray mount and associated tray and tray supporting structures, except the metal hinge pin 196, preferably are made of the same type plastic as identified above for the other embodiments.

Figure 28:
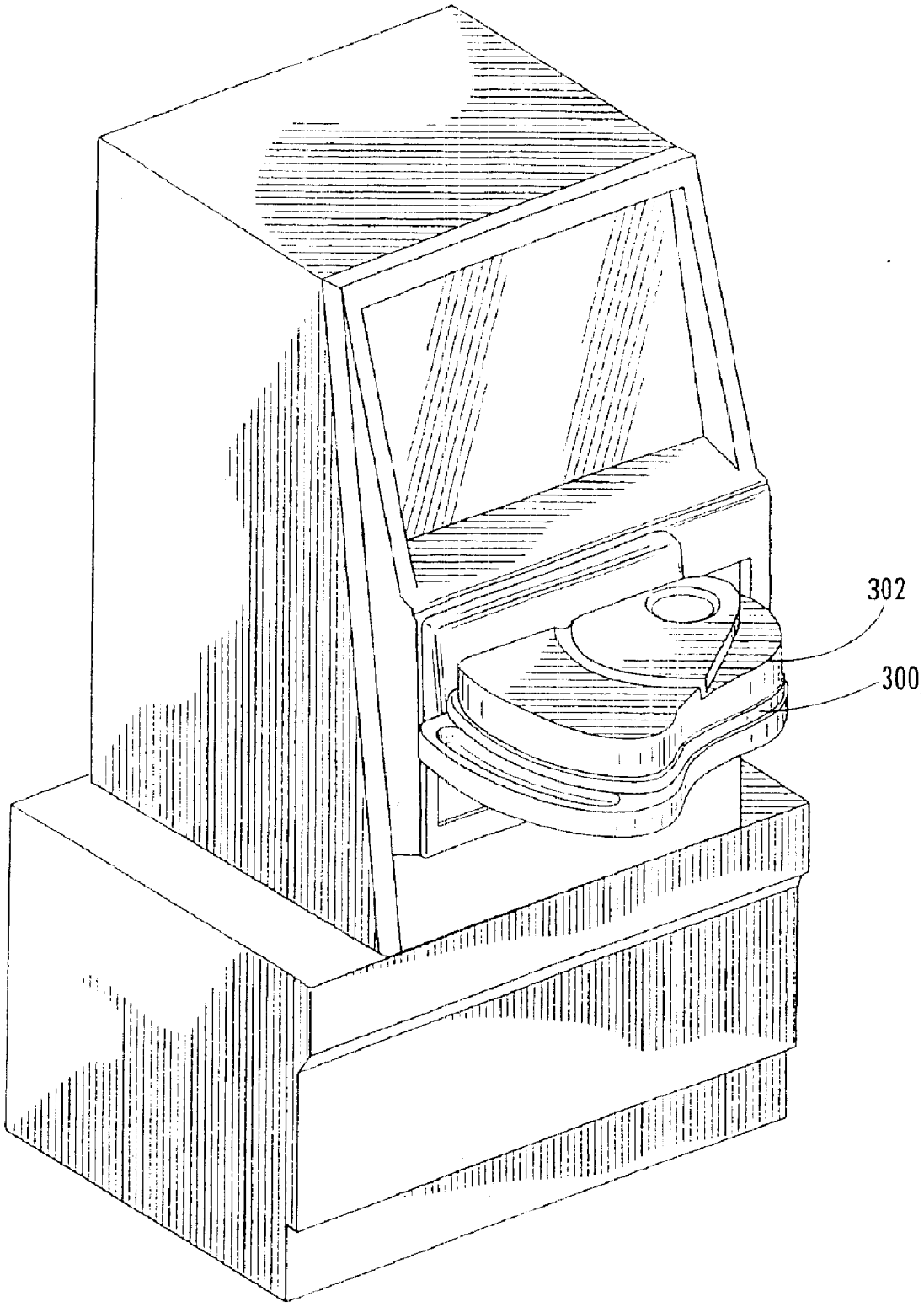
FIG. 28 is an isometric view of a gaming machine such as shown in FIG. 16 with additional removable and alterable trays mounted on the underlying support tray of FIG. 16.

With reference now to FIG. 28, the multiple food tray arrangement of FIG. 16 may be further altered by addition of yet additional trays, e.g., 300, and tray cover(s) 302. The additional tray 300 may provide a hot (or cold) plate for food that can be delivered to the game player (not shown) with a tray cover 302 mounted over the top of the hot (or cold) plate tray 300 in order to keep the food warm (or cold). The additional tray 300 and tray cover 302 are most preferably made of a ceramic material, or other material such as metal, which, when chilled or heated, may help maintain food at a chilled or heated temperature as desired.

With respect to all embodiments disclosed in this specification, other tray configurations may be utilized to vary the food (and other item) support configuration of the various trays disclosed herein. It is to be understood that the foregoing is a detailed description of preferred embodiments and alternatives. It can be seen that various embodiments provide various novel features not necessarily expressly identified in the Brief Summary of the Invention above. It is therefore to be understood that the scope of the invention is determined according to the accompanying claims and permitted equivalents as issued in connection with this specification.

What is claimed is:

1. A gaming apparatus, comprising:

a game machine housing comprising a front wall and at least one side wall, and a gaming interface positioned within the front wall;

a utility tray mount positioned on the front wall below the gaming interface;

a utility tray removably attached to the utility tray mount, wherein the utility tray mount is one or more selected from the group consisting of a lip, a bracket, a protuberance, at least one opening sized to engage a portion of the securing means and a ridge, and wherein the utility tray comprises one or more drink holders, one or more detents, and a means for securing the utility tray to the utility tray mount, wherein the securing means is one or more selected from the group consisting of a lip, a bracket, at least one rod extending from an edge of the utility tray and a tab;

a second utility tray reversibly mountable to the utility tray, wherein the second utility tray comprises one or more drink holders and one or more detents; and a tray cover capable of reversibly coupling to the utility tray or to the second utility tray.

2. A gaming apparatus, comprising:

a game machine housing comprising a front wall and at least one side wall, and a gaming interface positioned within the front wall;

a utility tray mount positioned on the front wall below the gaming interface, wherein the utility tray mount is a lip, a ridge, at least one protuberance, a recessed groove, at least one opening, or a combination thereof; and a utility tray removably attached to the utility tray mount, wherein the utility tray comprises one or more drink holders, one or more detents, and a means for securing the utility tray to the utility tray mount, wherein the securing means is one or more selected from the group consisting of a lip, a bracket, at least one rod extending from an edge of the utility tray and a tab;

a second utility tray reversibly mountable to the utility tray, wherein the second utility tray comprises one or more drink holders and one or more detents; and a tray cover capable of reversibly coupling to the utility tray or the second utility tray.

3. A gaming apparatus, comprising:

a gaming machine housing containing a gaming interface, wherein the gaming interface is positioned at the front of the gaming machine housing;

a foldable utility tray comprising one or more panels, wherein the utility tray is positioned adjacent to a side of the gaming machine in a first configuration, and the foldable utility tray is positioned below the gaming interface in a second configuration, and a third configuration wherein the foldable utility tray is positioned below the gaming interface and the first panel is positioned above the second panel; and a means for moving the foldable utility tray between the first configuration and the second configuration, wherein the panels of the foldable utility tray comprise a first panel and a second panel, wherein the first panel is hingedly coupled to the second panel.

4. The gaming apparatus of claim 3, further comprising a fourth configuration wherein the foldable utility tray is positioned below the gaming interface and the first panel and second panel are co-planar.

5. The gaming apparatus of claim 3, wherein the moving means is a support arm having a first end and a second end, wherein the first end of the support arm is pivotally connected to a side of the gaming machine housing and the second end of the support arm is pivotally connected to the foldable utility tray.

6. The gaming apparatus of claim 5, wherein the support arm is an L-shaped member.

7. The gaming apparatus of claim 5, wherein the support arm is cylindrical.

8. The gaming apparatus of claim 3, further comprising a housing adjacent to a side of the gaming housing, wherein the housing is sized to store the foldable utility tray.

9. The gaming apparatus of claim 3, wherein the foldable tray further comprises one or more detents wherein at least one detent is a drink holder.

10. A gaming apparatus, comprising:

a gaming machine housing containing a gaming interface, wherein the gaming interface is positioned at the front of the gaming machine housing;

a foldable utility tray comprising a first panel hingedly coupled to a second panel, wherein the utility tray is positioned adjacent to a side of the gaming machine in a first configuration, and the foldable utility tray is positioned below the gaming interface in a second configuration, and a third configuration wherein the foldable utility tray is positioned below the gaming interface and the first panel is positioned above the second panel; and a support arm having a first end and a second end, wherein the first end of the support arm is pivotally coupled to a side of the gaming machine housing and the second end of the support arm is pivotally coupled to the foldable utility tray.

11. The gaming apparatus of claim 10, further comprising a fourth configuration wherein the foldable utility tray is positioned below the gaming interface and the first panel and second panel are co-planar.

12. The gaming apparatus of claim 10, wherein a bottom surface of the first panel of the foldable tray further comprises one or more detents, wherein at least one detent is a drink holder, and a top surface of the second panel of the foldable tray further comprises one or more detents, wherein at least one detent is a drink holder.

13. The gaming apparatus of claim 10, wherein the support arm is an L-shaped member.

14. The gaming apparatus of claim 10, wherein the support arm is cylindrical.

15. A gaming apparatus, comprising:

a gaming machine housing containing a gaming interface, wherein the gaming interface positioned at the front of the gaming machine housing;

a foldable utility tray comprising a first panel and a second panel, wherein the first panel is hingedly coupled to the second panel;

a utility tray housing positioned adjacent to a side of the gaming machine housing; and a support arm having a first end and a second end, wherein the first end of the support arm is pivotally coupled to a side of the gaming machine housing and the second end of the support arm is pivotally coupled to an end of the first panel of the foldable utility tray, and wherein the foldable utility tray is positioned adjacent to a side of the gaming machine in a first configuration, and the foldable utility tray is positioned below the gaming interface in a second configuration, and a third configuration wherein the foldable utility tray is positioned below the gaming interface and the first panel is positioned above the second panel.

16. The gaming apparatus of claim 15, further comprising a fourth configuration wherein the foldable utility tray is positioned below the gaming interface and the first panel and second panel are co-planar.

17. The gaming apparatus of claim 15, wherein a bottom surface of the first panel of the foldable tray further comprises one or more detents, wherein at least one detent is a drink holder, and a top surface of the second panel of the foldable tray further comprises one or more detents, wherein at least one detent is a drink holder.

18. The gaming apparatus of claim 15, wherein the support arm is an L-shaped member.

19. The gaming apparatus of claim 15, wherein the support arm is cylindrical.

* * * * *